US010369488B1

(12) United States Patent
Pacheco

(10) Patent No.: US 10,369,488 B1
(45) Date of Patent: Aug. 6, 2019

(54) MAGNETIC SPINNING TOY

(71) Applicant: Arron Pacheco, Honolulu, HI (US)

(72) Inventor: Arron Pacheco, Honolulu, HI (US)

( * ) Notice: Subject to any disclaimer, the term of this patent is extended or adjusted under 35 U.S.C. 154(b) by 0 days.

(21) Appl. No.: 15/961,144

(22) Filed: Apr. 24, 2018

(51) Int. Cl.
*A63H 33/40* (2006.01)
*A63H 33/26* (2006.01)

(52) U.S. Cl.
CPC ..... *A63H 33/26* (2013.01); *A63H 33/40* (2013.01)

(58) Field of Classification Search
CPC ..... A63H 33/40
See application file for complete search history.

(56) References Cited

U.S. PATENT DOCUMENTS 1,669,748 A * 5/1928 Greger ..... A63H 33/40 446/218
6,592,424 B1 * 7/2003 Christianson ..... A63H 33/40 446/201
6,716,082 B1 * 4/2004 Chen Pan ..... A63H 33/40 446/217
2006/0211329 A1 * 9/2006 Chang ..... A63H 33/22 446/34

* cited by examiner

*Primary Examiner* — John A Ricci
(74) *Attorney, Agent, or Firm* — Jerry D Haynes; Law Office of Jerry D Haynes, PA

(57) ABSTRACT

A magnetic spinning toy that includes: a top magnetic stem; a bottom magnetic stem; a cylindrical core; a rod extending from each end of the cylindrical core creating a top rod and a bottom rod, where the top magnetic stem extends from the top rod and bottom magnetic stem extends from the bottom rod; a plurality of rotating wings mounted on the cylindrical core; and a connector for each rotating wing, wherein the connector includes a pivoting connection to each wing. The top and bottom magnetic stem may include a copper tube with embedded magnets. Preferably each pivoting connection includes a notch and a rivet.

4 Claims, 4 Drawing Sheets

MAGNETIC SPINNING TOY

CROSS REFERENCE TO OTHER APPLICATIONS

This application is a continuation in part to U.S. patent application Ser. No. 15/701,407 filed on Sep. 11, 2017.

BACKGROUND OF THE INVENTION

Field of Invention

The present invention relates to a magnetic spinning toy, which spins around a rod due to wind and magnetic force.

Description of Related Art

Spinning toys are a common device that are used to entertain children of various ages. Typically spinning toys are carousels or spinning objects about a rod or a pole. Various types of force are used with these toys including manual and wind force. Further magnetic force may be used in some applications in order to facilitate the movement of a spinning toy. Implementation of magnetics along with wind can provide a sustained spinning toy using various type of force and pressure.

SUMMARY OF THE INVENTION

The present invention relates to a magnetic spinning toy that includes: a top magnetic stem; a bottom magnetic stem; a cylindrical core; a rod extending from each end of the cylindrical core creating a top rod and a bottom rod, where the top magnetic stem extends from the top rod and bottom magnetic stem extends from the bottom rod; a plurality of rotating wings mounted on the cylindrical core; and a connector for each rotating wing, wherein the connector includes a pivoting connection to each wing. The top and bottom magnetic stem may include a copper tube with embedded magnets. Preferably each pivoting connection includes a notch and a rivet.

DETAILED DESCRIPTION

The present invention relates to a magnetic spinning toy that utilizes a plurality of wings spinning around a rod. This grouping of wings is attached to the rod in a wheel and spoke like configuration. Connectors extend from a center core where each wing is attached at a distal end of each connector. Each wing is configured in a manner to facilitate pivoting and movement to optimize the position of the wing in relation to wind force. A rod extends through a center point of the core between a top magnet and a bottom magnet. The top and bottom magnets influence the pivot points of the wings to provide optimum positioning to come in contact with wind force. This optimizing of the spinning toy therefore enables a user to create a spinning wheel of wings advantageously using wind optimized by the magnetic force. This complete assembly is placed within a frame assembly to create a unique and effective entertainment toy for a child.

Figure 1:
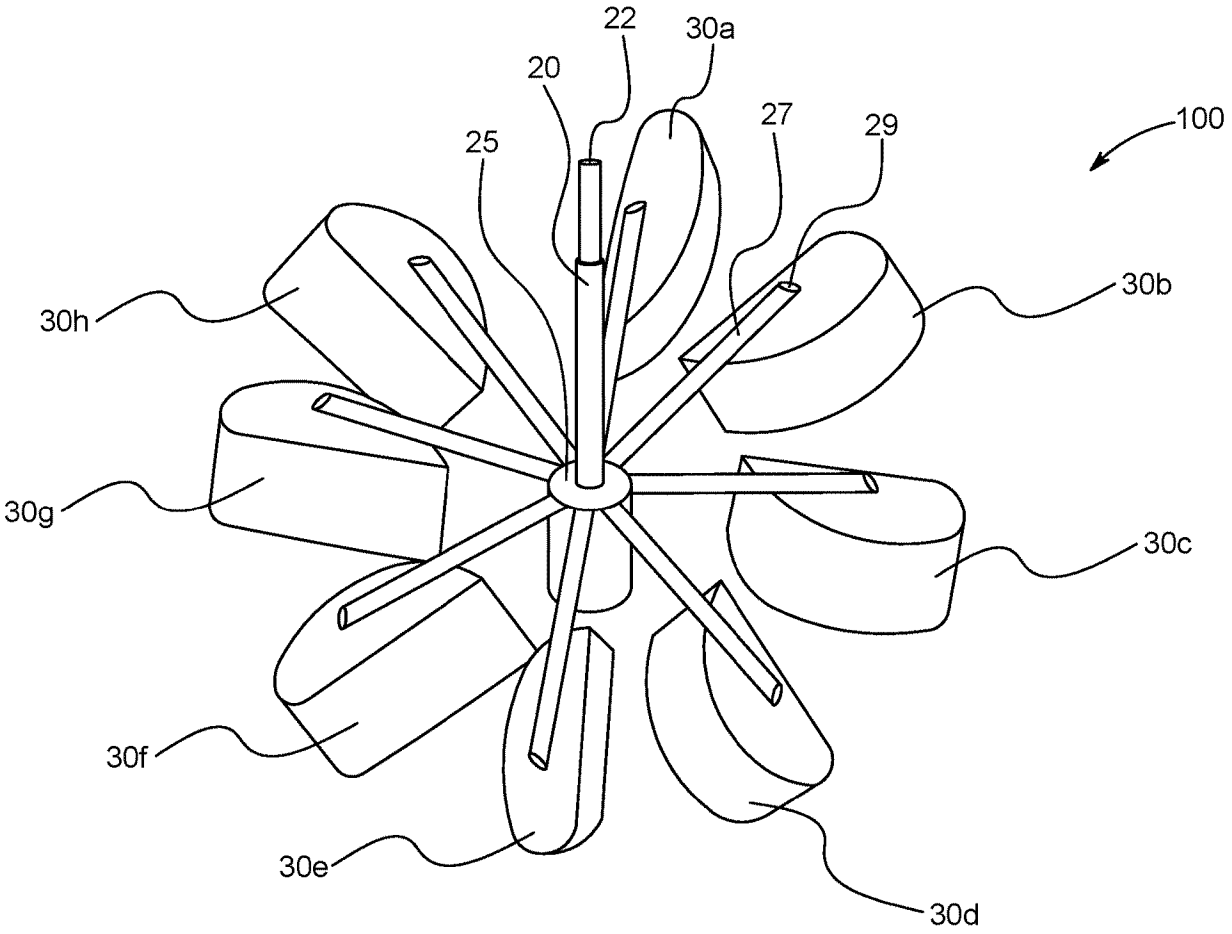
FIG. 1 shows a prospective view of a magnetic spinning toy in accordance with the present invention.

FIG. 1 depicts a spinning toy 100 includes a support rod 20 that mounts to a core 25. Connectors 27 extend vertically from the core 25. Each connector 27 supports a wing 30. The wings 30 are designated as wings 30*a* through 30*h* around core 25. The connectors 27 secure each wing 30*a*-30*h* in a stationary position to enable movement in a circle motion around the core 25. Extending from each end of the rod 20 is a magnetic stem 22. The magnetic stem 22 helps support the spinning toy 100 and encourages further movement of the wings 30. This configuration is initially shown in FIG. 1 with a perspective view where each wing 30 is supported with a connector 27.

Figure 2:
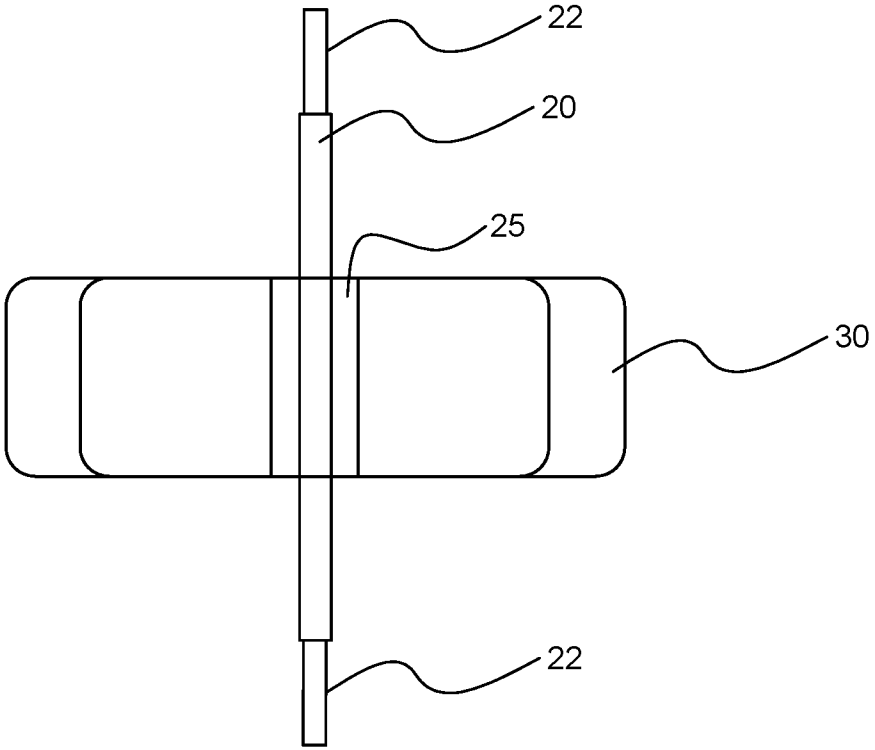
FIG. 2 shows a cross sectional view of the magnetic spinning toy in accordance with the present invention.
Figure 3:
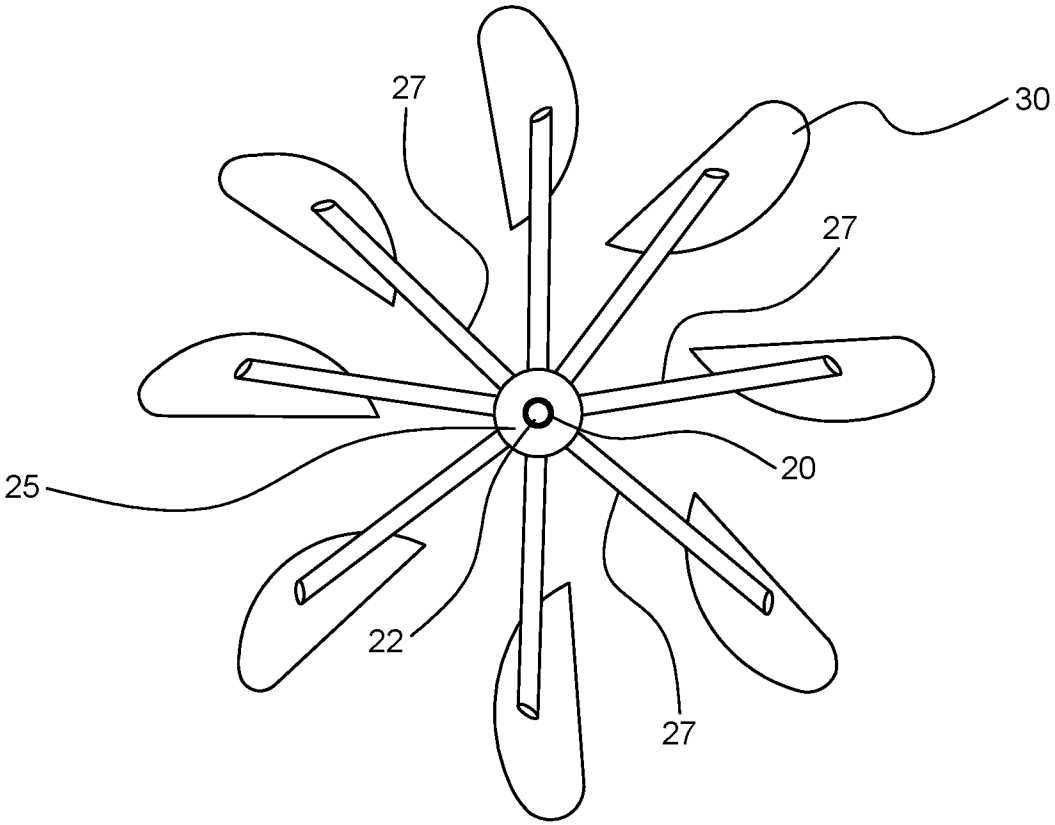
FIG. 3 shows a top view of the magnetic spinning toy in accordance with the present invention.
Figure 4:
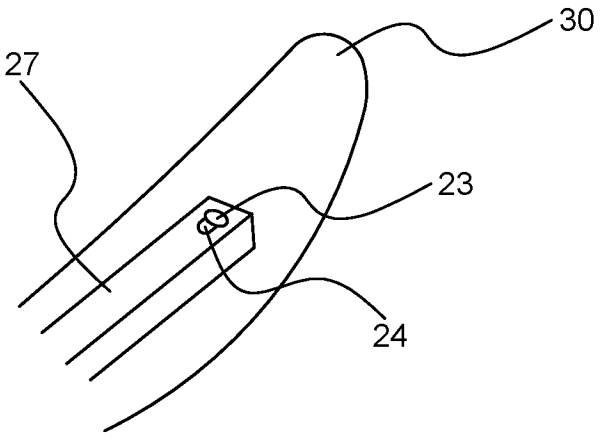
FIG. 4 shows an exploded view of an connector adjoining to a wing of the present invention.

A cross sectional view of the spinning toy 100 is shown in FIG. 2 showing the magnets 22 extending from each end of rod 20. The wings 30*a*-30*h* are shown attached to the core 25. A top view of the spinning toy is provided in FIG. 3 where the connectors 27 are shown extending from core 25. The connector 27 attaches to each wing 30 as shown in an exploded view of FIG. 4. The exploded view further shows a notch 24 provided with a rivet 23 attaching the wing 30 to connector 27. This notch 24 and rivet 23 connection allows for the slight movement of the wing axially to encourage the circle movement of the spinning toy. The notch 24 and rivet 23 provide a pivot point to optimize the application of wind force onto each wing 30*a*-30*h*. The pivot point is also influenced by magnetic forces between the magnets 22. The magnet force created by magnets 22 increase the application of wind force onto the wings and as a result increase speed of rotation of the wings 30*a*-30*h* around the core 25. A frame assembly not shown may be used to support the spinning toy 100 between the magnets 22 at each end thereof.

As a result, this complete magnetic spinning toy provides a novel and interesting configuration of entertainment for any child. Further the pivoting of each wing enables the toy to position for the best angle to receive wind force for spinning purposes. The instant invention has been shown and described in what it considers to be the most practical and preferred embodiments. It is recognized, however, that departures may be made there from within the scope of the invention and that obvious modifications will occur to a person skilled in the art.

What is claimed is:

1. A magnetic spinning toy comprising:

a. a top magnetic stem;

b. a bottom magnetic stem;

c. a cylindrical core;

d. a rod extending from each end of the cylindrical core creating a top rod and a bottom rod, where the top magnetic stem extends from the top rod and bottom magnetic stem extends from the bottom rod;

e. a plurality of rotating wings mounted on the cylindrical core; and f. a connector for each rotating wing, wherein the connector includes a pivoting connection to each wing.

2. The magnetic spinning toy according to claim 1, wherein said top magnetic stem includes a copper tube with embedded magnets.

3. The magnetic spinning toy according to claim 1, wherein said bottom magnetic stem includes a copper tube with embedded magnets.

4. The magnetic spinning toy according to claim 1, where each pivoting connection includes a notch and a rivet.

* * * * *